United States Patent [19]

Tai

[11] 3,972,141

[45] Aug. 3, 1976

BEST AVAILABLE COPY

[54] TELEPHONE NUMBER INDEXING DEVICE

[76] Inventor: Masaru Tai, 5-4-35-1208, Minami-Aoyama Minato, Tokyo, Japan, 107

[22] Filed: July 25, 1975

[21] Appl. No.: 599,020

Related U.S. Application Data

[63] Continuation of Ser. No. 477,045, June 6, 1974, abandoned.

[52] U.S. Cl. ..... 40/78; 40/336

[51] Int. Cl.[2] ..... G09F 11/30

[58] Field of Search ..... 40/78.05, 78, 16, 104.01, 40/336–339

[56] References Cited

UNITED STATES PATENTS 1,731,422 10/1929 Johnson ..... 40/339 X 3,623,250 11/1971 Misenko ..... 40/16

*Primary Examiner*—Russell R. Kinsey
*Assistant Examiner*—John H. Wolff
*Attorney, Agent, or Firm*—George B. Oujevolk

[57] ABSTRACT

There is disclosed a telephone number indexing device which comprises a casing having an upper opening and housing therein a plurality of cards on which telephone numbers are recorded. When any card is pulled upwards from the casing through the upper opening thereof for learning a required telephone number, the card is held in place in a manner that card guide and stopper means on the inner wall of casing or resilient members 4 provided in the casing are utilized for retaining a stopper 15 provided in the lower portion of each card.

5 Claims, 8 Drawing Figures

TELEPHONE NUMBER INDEXING DEVICE

This is a continuation of U.S. Patent Application Ser. No. 477,045 filed on June 6, 1974 and now abandoned.

BACKGROUND OF THE INVENTION

This invention relates to a telephone number indexing device.

Hitherto, various type telephone number indexing devices or means have been proposed, and most of them have been of a book type or a file type. Such a book type telephone number index or file type index, when opened for knowing a required telephone number, takes a relatively large space of the confined area on which a telephone is set. This is inconvenient for dialing. Such a book type telephone number index is further disadvantageous in that addition of another card is difficult when there arises an increase in telephone numbers to be recorded, resulting in the necessity of preparing another telephone number index booklet. This is extremely troublesome.

It is accordingly an object of the present invention to provide a telephone number indexing device, in which there is provided a casing having an upper opening and housing therein a plurality of telephone number recorded cards each provided with an index piece. Each card is adapted to be pulled upwards from the card casing for learning a required telephone number and is retained at a given position, without the possibility of falling downwards during use, and said card is returned, without trouble, into the casing by slightly pushing the same after the dialing is finished.

In one embodiment of the invention, stoppers, or tabs, on the lower region of the respective telephone number recorded cards are held between resilient members and a lock means when it is desired to read a telephone number from a card. In another embodiment, the stoppers ride entirely over resilient members of different design so that the respective cards sit on top of the resilient members when a card is being read. Also disclosed is a cartridge type casing which can be stacked with similar casings to increase the capacity for telephone numbers.

DETAILED DESCRIPTION OF THE INVENTION

Figure 1:
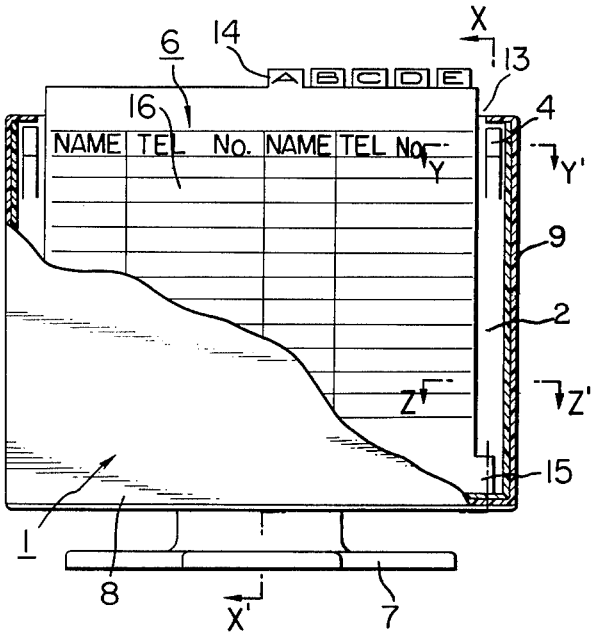
FIG. 1 is a longitudinal cross-sectional front view of a telephone number indexing device according to one embodiment of the present invention.

The body proper of telephone number indexing device is made of ABS resin or high impact polyethylene which is resilient and tough and mainly composed of a foot portion 7 and an indexing card casing 8 having a front plate and a rear cover plate 2. The rear cover plate 2 has vertically extending right-hand and left-hand side plates 11 having a projection 12 which is fitted in each inner slot 10 provided in the right- and left-hand side plates 9 of the indexing card casing 8, and thus, an upper opening 13 is formed when the rear cover plate 2 is fitted in the casing 8, to thereby form a box-shaped casing.

Figure 7:
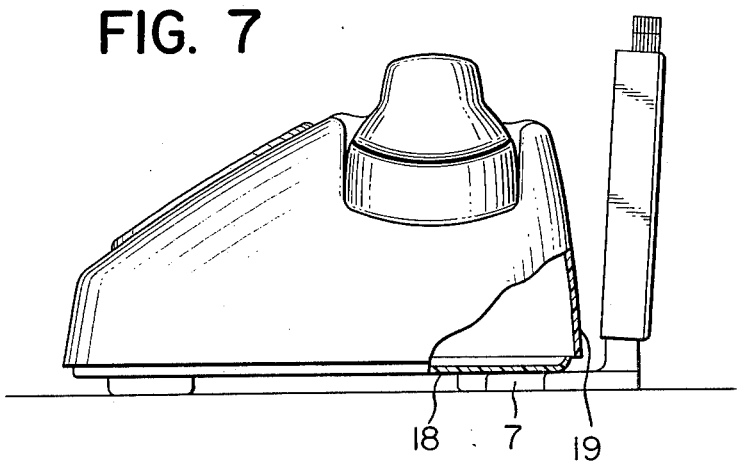
FIG. 7 is a side view of the telephone number indexing device, shown attached to a telephone set; and, FIG. 8 is a cross-sectional view illustrating a cartridge type telephone number indexing device according to another embodiment.

The foot portion 7 is formed integrally with the card casing 8 and has a flat foot face on which a telephone set is rested. A packing material such as sponge may be bonded to the flat foot face, if required. The telephone number indexing device is attached to the telephone set, with its foot portion 7 being securely attached to the under-side of the base portion 18 of the telephone set, in a manner to closely contact thereto, as shown in FIG. 7.

The telephone number recorded card casing 8 houses therein a plurality of index cards 6 each formed with an index piece 14 on which an alphabetical letter or other letter is given for classification, the position of said index piece being different every card. Respective index pieces 14 project from the upper opening 13 of casing 8 when the index cards 6 are housed in the casing 8.

Figure 2:
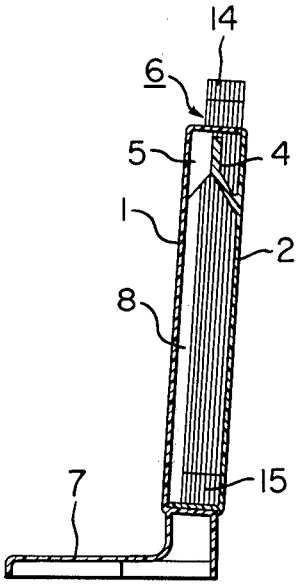
FIG. 2 is a cross-sectional view taken along the line X–X′ of FIG. 1.
Figure 3:
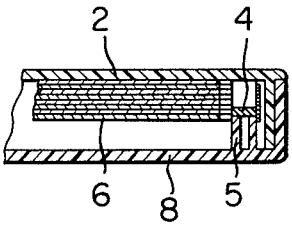
FIG. 3 is a cross-sectional view taken along the line Y–Y′ of FIG. 1.
Figure 4:
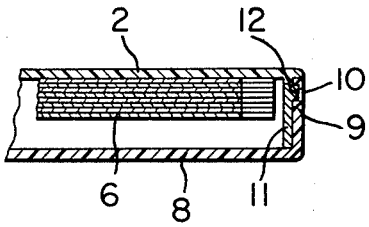
FIG. 4 is a cross-sectional view taken along the line Z–Z′ of FIG. 1.
Figure 5:
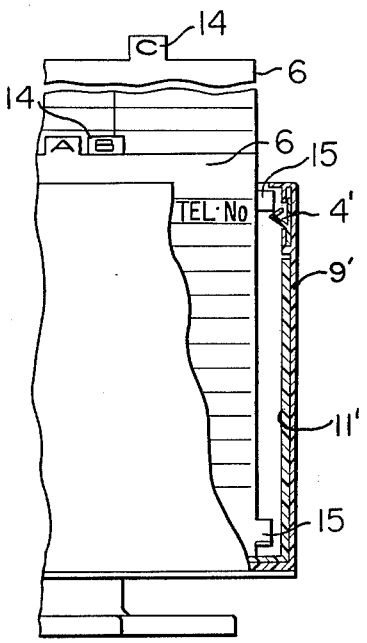
FIG. 5 is a longitudinal cross-sectional front view of an essential part of the telephone number indexing device according to another embodiment of the present invention.
Figure 6:
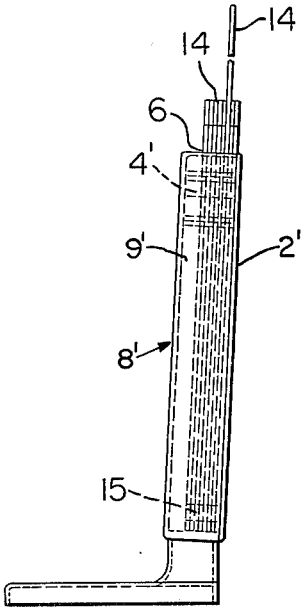
FIG. 6 is a right-hand side elevational view of FIG. 5.

For taking out an index card from the casing 8, the index piece 14 is pulled by hand upwards through the upper opening of card housing 8, until a tab, or stopper 15 of the index card 6 is held in place. In the first embodiment of the invention, illustrated in FIGS. 1 through 4, the stoppers 15 on the respective cards 6 are held between or by card guide and lock means 5 provided on the upper inner wall of opposite side plates of casing 8 and resilient members 4 provided on the inner wall of rear cover plate 2. In the second embodiment, illustrated in FIGS. 5 and 6, the stopper 15 is locked under the action of the resilient members 4′ provided on the rear cover plate 2. Thus, the index card 6 is temporarily retained in place, so that a telephone number chart 16 recorded on the card is fully exposed from the casing 8 to be read at a glance by the user. The relationship between the resilient members 4′ and the stopper 15 of index card 6 will be clearly seen from FIGS. 5 and 6. The resilient members 4′ are attached to the inner wall of opposite side plates 9′ of index card housing 8′. Alternatively, the resilient members may be provided on the inner wall of opposite side plates 11′ of rear cover plate 2′. The resilient members 4′ and the stopper 15 may be so designed so that the stoppers ride over the resilient members 4′ so as to be locked on the resilient members and the upper portion of index card casing 8′. This is illustrated best in FIG. 5, wherein the stopper 15 of card "C" is resiliently locked atop resilient member 4′. And while not specifically illustrated in FIG. 2, the stoppers 15 are adapted to be held between lock means 5 and resilient members 4 (which would flex to the right in FIG. 2) when a card 6 is elevated for viewing.

As is apparent from the foregoing, the telephone number indexing device according to the present invention is of the vertical type which is directly attached to the telephone set, with the result of reduction in space. Since the telephone number indexing device is securely attached to the telephone set, there is no probability of the device being missed. For learning a required telephone number, it suffices to pull out the index card from the casing by clamping the index piece thereof. For housing the index card in the card casing after the dialing is finished, the index card is slightly pushed into the casing. Telephone numbers are recorded onto a chart in a vertical direction such that the dialing may be effected with ease and accurately.

For replacement of the index card 6 with another, insertion of a new index card or removal of the obsolete index card, the rear cover plate 2 is demounted from the index card casing 8.

Figure 8:
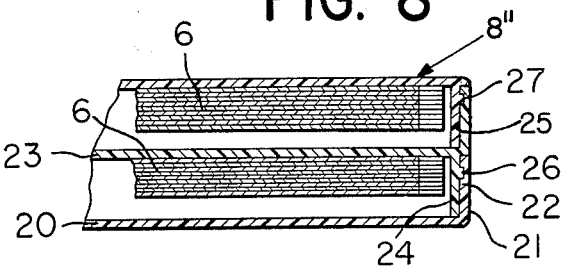

FIG. 8 is a cross-sectional view showing another embodiment of the present invention, in which the index card casing 8'' is of the cartridge type. In this embodiment, the cover plate 20 having an inverted U shape in cross-section is provided with cavities 22 in opposite side plates or projecting plates 21 thereof, in which cavities are forcibly fitted projections 24 and 25 of a coupling member 23, said projections being provided in the frontwardly and rearwardly extending portions thereof. Desired numbers of coupling member may be added to the casing, thereby increasing the dimension of the index card casing.

What is claimed is:

1. A card index for telephone numbers wherein the index is adapted to hold a plurality of index cards having a generally rectangular format, the index comprising:

a. index cards having a top portion, a bottom portion, and wing-like stopper tabs extending outwards from opposed sides of each of the cards at the bottom portion thereof and an index tab at the top portion thereof for pulling the card partly out of the casing;

b. an L-shaped foot portion with one leg of said foot portion extending under and being retained by a telephone;

c. a rectangular, elongated casing having an inner wall mounted on the other leg of said foot portion, and having an interior defining an index card holding chamber for holding therein a plurality of said rectangular index cards in an aligned manner with the index tabs extending outwardly of a casing opening; said casing having an upper longitudinal opening, vertically extending, right-hand and left-hand side plates, a front plate, and a rear cover plate, means for removably mounting said rear cover plate on said casing to facilitate the insertion of index cards into said chamber; and d. a pair of card guide and stopper means mounted in opposed relationship along the inner wall of said casing adjacent said upper opening for engaging and retaining the stopper tabs of an associated index card, respectively whereby, any one of said index cards may be physically lifted by its tab into an exposed position, out of said casing, until the stopper tabs engage the respective card guide and stopper means.

2. The card index recited in claim 1, wherein said card guide and stopper means comprises two lock means mounted on the inner wall of said casing, and at least one resilient member resiliently bearing against each lock means, said lock means and resilient members cooperatively associated so that when a stopper tab of an index card is positioned therebetween, the card is retained in a position extending substantially entirely outwards of said opening.

3. The card index recited in claim 2, wherein said lock means and resilient members are shaped to guide the stopper tabs of said index cards therebetween.

4. The card index recited in claim 1, wherein said card guide and stopper means comprises at least one resilient member mounted on the inner wall of each of said casing side plates and extending inwardly from said side plates into the domain of said stopper tabs to selectively engage the stopper tabs of the index cards, means for camming said resilient members toward their associated side plates by said stopper tabs and resiliently springing away from their associated side plates when relaxed so that when a stopper tab has been cammed over a resilient member, the associated index card is retained in a position extending substantially entirely outwards of said opening or if once removed, returned to said chamber.

5. The card index recited in claim 1, wherein said casing is of the piggy-back cartridge type, said rear cover plate has opposed side wall projecting plates with a plurality of cavities therein, each of said cavities has a coupling wall extending longitudinally across said casing to form the wall of a separate card-holding chamber, a plurality of said chambers are joined piggy-back, one to the other, and each of said coupling wall members has lateral projections with engaging means for engaging said cavities.

* * * * *